US011731382B2

(12) United States Patent
Drogin

(10) Patent No.: US 11,731,382 B2
(45) Date of Patent: Aug. 22, 2023

(54) PRESSING APPARATUS

(71) Applicant: HARBURG-FREUDENBERGER MASCHINENBAU GMBH, Hamburg (DE)

(72) Inventor: Sergey Drogin, Seevetal (DE)

(73) Assignee: HARBURG-FREUDENBERGER MASCHINENBAU GMBH, Hamburg (DE)

( * ) Notice: Subject to any disclaimer, the term of this patent is extended or adjusted under 35 U.S.C. 154(b) by 158 days.

(21) Appl. No.: 17/106,768

(22) Filed: Nov. 30, 2020

(65) Prior Publication Data

US 2021/0162696 A1 Jun. 3, 2021

(30) Foreign Application Priority Data

Dec. 2, 2019 (DE) ..... 10 2019 132 707.5

(51) Int. Cl.

| | |
|---|---|
| ***B30B 9/18*** | (2006.01) |
| ***B30B 9/14*** | (2006.01) |
| ***B30B 9/26*** | (2006.01) |

(52) U.S. Cl.

CPC ..... *B30B 9/18* (2013.01); *B30B 9/14* (2013.01); *B30B 9/267* (2013.01)

(58) Field of Classification Search

CPC .. B30B 9/02; B30B 9/12; B30B 9/122; B30B 9/125; B30B 9/14; B30B 9/16; B30B 9/163; B30B 9/166; B30B 9/26; B30B 9/262; B30B 9/267

See application file for complete search history.

(56) References Cited

U.S. PATENT DOCUMENTS

| | | | | |
|---|---|---|---|---|
| 3,130,666 | A * | 4/1964 | Hiller | B30B 9/267 100/129 |
| 4,297,943 | A * | 11/1981 | Laurich-Trost | B30B 9/26 100/129 |
| 2013/0199383 | A1 * | 8/2013 | Horton | B30B 9/26 100/145 |

* cited by examiner

*Primary Examiner* — Matthew Katcoff

(74) *Attorney, Agent, or Firm* — Lucas & Mercanti, LLP; Klaus P. Stoffel

(57) ABSTRACT

A pressing apparatus in a manner of a cage-type screw press, wherein the strainer cage is split up into a plurality of strainer-cage segments. The strainer-cage segments can be sealed along their adjacent sides with the aid of sealing devices so that liquids and solids are effectively prevented from escaping from the gaps between the strainer-cage segments.

8 Claims, 6 Drawing Sheets

PRESSING APPARATUS

CROSS-REFERENCE TO RELATED APPLICATIONS

The present application claims priority of DE 10 2019 132 707.5, filed Dec. 2, 2019, the priority of this application is hereby claimed, and this application is incorporated herein by reference.

BACKGROUND OF THE INVENTION

The invention relates to a pressing apparatus having a strainer cage which is formed from at least two parts.

The prior art discloses various pressing apparatuses for separating free-flowing, liquid or thixotropic constituents from different substances, solids and organic or inorganic materials using pressing operations. In particular for vegetable products and animal carcasses, cage-type screw presses are proving successful for separating liquids and, in particular, oil-containing constituents, considerable pressing forces and pressing pressures acting on the pressing material, or on the compressed matter containing the oil-containing constituents, in the pressing chamber of said screw presses.

The pressing chamber, also referred to as the strainer chamber, is geometrically delimited at least to some extent by at least one so-called strainer cage. It is often the case that the strainer cages are designed with a cylindrical or hollow-cylindrical geometry and subdivided into individual cage-bar zones for accommodating and/or retaining cage bars.

Cage bars and/or strainer cages of the type mentioned in the introduction are used in the field of apparatuses for pressing free-flowing or liquid substances out of materials or products which have been introduced into the apparatus. It is possible, for example, for liquid substances to be pressed out of animal carcasses, slaughterhouse waste or oil-containing fruits, seeds or plants. The pressing apparatuses are of drum-like design and the cage bars extend in a longitudinal direction of the drum. The substances which are to be processed are also transported in this longitudinal direction. In the region of a drum exit, the residual substances are discharged from the drum interior in a more or less moisture-free state. Transportation through the drum takes place using a pressure-applying screw conveyor.

As the substances are being transported through the drum, the liquids which are contained in the input substances are pressed out by the pressing operation between the boundary surfaces of the screw helixes of the feeding screw and the cage bars. In order to allow the squeezed-out free-flowing constituents to flow out, the cage bars are arranged at gap-like distances relative to one another. In order to ensure optimum progression of the pressing operation, the cross-sectional surface area of the screw helix decreases in size from the inlet in the direction of the outlet.

The main aim of the pressing operation is to provide for the best possible separation of free-flowing and, in particular, oil-containing constituents and solid constituents from the pressing material. A further aim is to achieve the highest possible volume of flow. Moves are made to achieve both aims in optimum fashion by virtue of the machine elements for applying the pressing forces being designed with maximum power and the pressing chamber being made of a suitable geometry.

The at least one strainer cage, which delimits the pressing chamber, is usually of multi-part design. In a tried-and-tested embodiment of a cage-type screw press, each strainer cage, or each strainer-cage portion, can be split into two parts, two strainer-cage halves being formed as a result. The separation runs in a plane parallel to the longitudinal axis of the hollow-cylindrical or drum-like strainer cage.

By virtue of the at least one strainer cage, or of the strainer-cage portions, being split into strainer-cage halves, the strainer cage and therefore the pressing chamber of the cage-type screw press can be opened and is therefore accessible for installation, maintenance and/or cleaning work.

For reliable operation of the cage-type screw press, the strainer-cage halves have to be capable of being firmly connected to another. Furthermore, it is necessary to seal the strainer cage along the adjacent sides of the strainer-cage halves in order to avoid the situation where liquids and solids which have been pressed out, in particular of the pressing material, escape from the gaps which are located between the strainer-cage halves.

According to the prior art, the strainer-cage halves are sealed only via the abutting surfaces in particular the clamping bars and scrapers of the assembled strainer cage.

However, the manufacturing tolerances, which can vary in addition between the clamping bars and scrapers, mean that perfect sealing of the strainer cage along the contact surfaces of the strainer-cage halves is not possible. As a result, liquids and solids can escape through the gaps between the strainer-cage halves, wherein the solids, oils and fats become embedded in any openings present. They are therefore also deposited, inter alia, in the bores for the cage bolts and embed the cage bolts in the bores. The embedded cage bolts then require a considerable amount of additional outlay in order to be removed, for example during maintenance work.

SUMMARY OF THE INVENTION

It is therefore an object of the invention to specify a pressing apparatus of the type mentioned in the introduction which makes it possible to avoid the situation where pressed-out liquids and solids escape between the segments of the strainer cage.

This object is achieved according to the invention by a pressing apparatus having the features described below.

The features of a pressing apparatus which are disclosed hereinbelow form a constituent part of the invention both individually and in all feasible combinations.

A pressing apparatus according to the invention is designed in the form of a cage-type screw press and has a tubular or hollow-cylindrical pressing chamber. The pressing chamber is delimited on its longitudinal outer side by at least one strainer cage.

In one embodiment of the invention, the strainer cage is arranged in a cage frame, which is for example of at least partially rib-like design.

The pressing chamber has arranged within it a pressing and feeding screw, by means of which pressing material can be transported from a supply opening, through the pressing chamber, to an exit opening.

The pressing and feeding screw has a screw shaft, on the lateral surface of which is arranged a helical screw thread, by means of which the screw helix is formed.

In one embodiment of the invention, a plurality of pressing and feeding screws are arranged one behind the other in the cage-type screw press.

In one embodiment of the invention, the at least one strainer cage has a plurality of cage bars, which are arranged one beside the other in the strainer cage such that gaps of defined width are realized between the cage bars, it being possible for a liquid which has been pressed out of the pressing material to be discharged out of the pressing chamber through said gaps.

In one embodiment of the invention, the pressing chamber is delimited by a plurality of strainer-cage portions arranged one behind the other in the feeding direction of the pressing and feeding screw. The length of the cage bars here is adapted to the length of the respective strainer-cage portion.

According to the invention, the at least one strainer cage, or strainer-cage portion, is split into at least two strainer-cage segments.

In one embodiment of the invention, the strainer cage, or the respective strainer-cage portion, is split into strainer-cage segments along at least one plane, wherein the longitudinal axis of the hollow-cylindrical pressing chamber is located in the at least one plane, or wherein the at least one plane is oriented parallel to the longitudinal axis of the hollow-cylindrical pressing chamber.

In a preferred embodiment of the invention, the at least one strainer cage is split into two strainer-cage segments, the strainer-cage segment therefore being formed by strainer-cage halves.

In a particularly preferred embodiment of the invention, the at least one strainer cage is split approximately centrally and horizontally into two approximately equal strainer-cage segments.

In a closed state of the strainer cage, the strainer-cage segments have adjacent surfaces, also referred to hereinbelow as contact surfaces.

According to the invention, at least one sealing device is arranged in the region of the contact surfaces of the strainer-cage segments, and this sealing device makes it possible to seal gaps which are present between the contact surfaces of the strainer-cage segments even in a closed state of the strainer cage.

In a preferred embodiment of the invention, the pressing chamber is sealed over its entire length with the aid of sealing devices.

In one embodiment of the invention a sealing device is provided for each contact-surface pair of the strainer-cage segments of a strainer cage or strainer-cage portion.

In one embodiment of the invention, the sealing devices serve to seal the longitudinal-side contact surfaces of the strainer-cage segments.

In a preferred embodiment of the invention, in the region of the contact surfaces of the strainer-cage segments, the pressing apparatus has clamping bars, by means of which the cage bars of a strainer-cage segment can be fixed in the latter.

In a further preferred embodiment of the invention, in the region of the contact surfaces of the strainer-cage segments, the pressing apparatus also has scrapers, which project into the strainer cage between the screws of strainer-cage portions arranged one behind the other, in order to prevent rotation of the pressing material in the cage-type press.

In a further embodiment of the invention, a cage-bar assembly which is formed from a plurality of cage bars, and can be installed as an at least temporary unit in the strainer cage, can be fixed in each strainer-cage segment with the aid of the clamping bars and the fastening means.

In a further embodiment of the invention, the clamping bars form part of a cage-bar assembly. The cage-bar assembly can be fixed in a strainer-cage segment with the aid of the clamping bars and fastening means.

In one embodiment of the invention, the sealing devices are arranged in the region of the clamping bars and/or scrapers.

In a preferred embodiment of the invention, the sealing devices are arranged in the region of the outer side of the clamping bars and/or scrapers, as seen in the radial direction of the strainer cage.

In one embodiment of the invention, the sealing devices are manufactured from in each case at least one strip-form material.

In a preferred embodiment of the invention, the strip-form material of the sealing device has been deformed at least partially by bending.

In one embodiment of the invention, the at least one sealing strip of a sealing device is manufactured from a metal sheet.

In a further embodiment of the invention, the at least one sealing strip of a sealing device is manufactured from a plastic.

In one embodiment of the invention, the at least one sealing strip of a sealing device is designed and arranged such that, when the strainer-cage segments are being fixed in the strainer cage, said sealing strip can be deformed such that it is possible to realize form-fitting and/or force-fitting sealing of the gap which remains between the contact surfaces of the strainer-cage segments.

In one embodiment of the invention, the sealing strip is deformed elastically and/or plastically. In the event of elastic and plastic deformation of the sealing strip, in each case the deformation is partially elastic and partially plastic.

In a particularly preferred embodiment of the invention fully elastic deformation of the sealing strip or of the sealing strips takes place when the strainer-cage segments are being installed, it therefore being possible for said sealing strip or strips to be used a number of times.

In a preferred embodiment of the invention, the contact surfaces of the strainer-cage segments have a recess or a groove in the region of the outer side, as seen in the radial direction of the strainer cage, and the at least one sealing strip is arranged at least in part in said recess or groove.

In a particularly preferred embodiment of the invention, the contact surfaces of the two in each case adjacent strainer-cage segments have, located opposite one another, corresponding recesses or grooves, in which the at least one sealing strip is arranged at least in part.

In one embodiment of the invention, in the region of the contact surfaces of two adjacent strainer-cage segments, at least one clamping bar or a scraper has a recess or a groove in the region of the outer side, as seen in the radial direction of the strainer cage, the at least one sealing strip being arranged at least in part in said recess or groove.

In a particularly preferred embodiment of the invention, in the region of the contact surfaces of the in each case adjacent strainer-cage segments, the two clamping bars and/or scrapers have, located opposite one another, corresponding recesses or grooves, in which the at least one sealing strip is arranged at least in part.

In one embodiment of the invention, at least one clamping bar and/or scraper has a recess on the side which is located opposite the contact surface.

In a preferred embodiment of the invention, a sealing strip is formed such that, on the outer side of a first clamping bar, as seen in the radial direction of the strainer cage, said sealing strip grips around said clamping bar, and therefore a first end of the sealing strip is located in a recess arranged on that side of the first clamping bar which is located opposite the contact surface, and a second end is located in a recess arranged on the side of the contact surface.

In a preferred embodiment of the invention, the sealing device has a second sealing strip, which is arranged on a second clamping bar of the aforementioned type such that a first end of the second sealing strip is located in a recess arranged on that side of the second clamping bar which is located opposite the contact surface, and the second sealing strip extends along the outer side of the second clamping bar, as seen in the radial direction of the strainer cage.

The aforementioned embodiment of the sealing device means that the first and the second clamping bars can be manufactured to be identical, and therefore the production costs of the system are not increased by different kinds of clamping bar.

In one embodiment of the invention, the second end of the first sealing strip is designed such that, when the strainer-cage segments are connected to form a strainer cage or a strainer-cage portion, said second end can be deformed by the forces of the contact surfaces braced against one another, and it is therefore possible to realize form-fitting sealing of the gap which is located between the contact surfaces.

In particular, the second end of the sealing strip projects from the contact surface of the respective strainer-cage segment in the direction of the corresponding strainer-cage segment.

It is particularly preferable for the second end of the sealing strip to project from the contact surface of the respective strainer-cage segments, in the direction of the corresponding strainer-cage segment, to an extent which is greater than a depth of a recess or groove arranged on the side of the corresponding strainer-cage segment.

In a preferred embodiment of the invention, the second end of the first sealing strip is bent in a manner similar to a U shape, wherein the U is closed in the direction of the opposite contact surface.

Forming a second end of the first sealing strip in a manner similar to a V shape is also conceivable according to the invention.

The second end of the first sealing strip is flexible to a certain extent, and therefore, when the strainer cage is being closed, said second end slides into a groove arranged on the opposite contact surface.

Using sealing devices according to the invention makes it possible to realize easy-to-install and easy-to-maintain sealing of the pressing chamber or of the strainer cage at the connecting locations of the strainer-cage segments.

The various features of novelty which characterize the invention are pointed out with particularity in the claims annexed to and forming a part of the disclosure. For a better understanding of the invention, its operating advantages, specific objects attained by its use, reference should be had to the drawings and descriptive matter in which there are illustrated and described preferred embodiments of the invention.

DETAILED DESCRIPTION OF THE INVENTION

Figure 1:
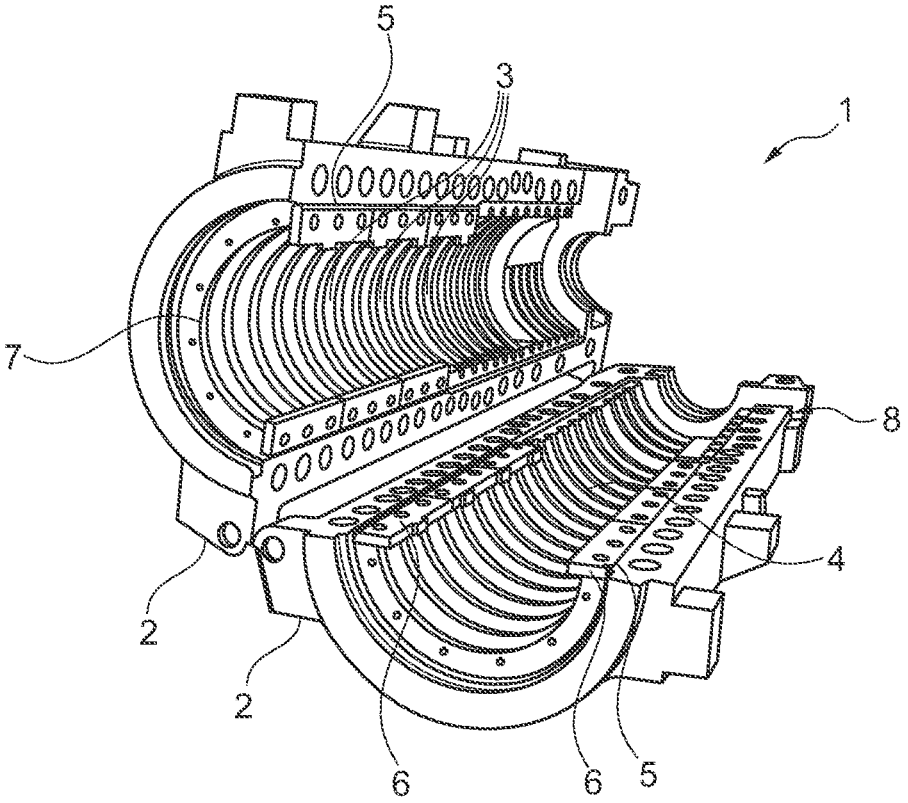
FIG. 1: shows a perspective illustration of a cage frame of a pressing apparatus according to the invention in an open state, without cage bars inserted and without a pressing and feeding screw.

FIG. 1 is a perspective illustration of a cage frame (2) of a pressing apparatus (1) according to the invention in an open state, without cage bars inserted and without a pressing and feeding screw. The cage frame (2) is split into an upper cage frame (2*a*) and a lower cage frame (2*b*), which each have a basic shape similar to half a hollow cylinder. The strainer cage, which can be inserted into the upper cage frame (2*a*) and the lower cage frame (2*b*), is split up in the longitudinal direction into a plurality of strainer-cage portions (3). Each strainer-cage portion (3) here is split into two strainer-cage segments (4), wherein in each case one strainer-cage segment (4) of a strainer-cage portion (3) is arranged in the respective upper or lower cage frame (2*a*, 2*b*).

Both the cage frame (2) and the strainer-cage segments (4) have contact surfaces (5), which, in a closed state of the strainer cage or of the cage frame (2), are adjacent to one another for the corresponding subassemblies. Furthermore, the strainer-cage segments (4) have clamping bars (6), which serve to fix cage bars (not illustrated) in the respective strainer-cage segment (4) and to fasten the respective strainer-cage segment (4) in the strainer cage or strainer-cage portion (3) on the cage frame (2). On the left-hand side of the lower strainer-cage segment (4) and on the right-side in the upper strainer-cage segment (4), scrapers, which project into the pressing chamber, are arranged on the clamping bars (6).

The pressing chamber, which is delimited by the strainer cage, has, on the end sides, a first opening (7), as an outlet or exit opening, and an entry opening (8) for the pressing material. An inlet shaft (not illustrated) is arranged in the region of the opening (8), and the pressing material can be fed into the strainer cage through said inlet shaft.

Figure 2:
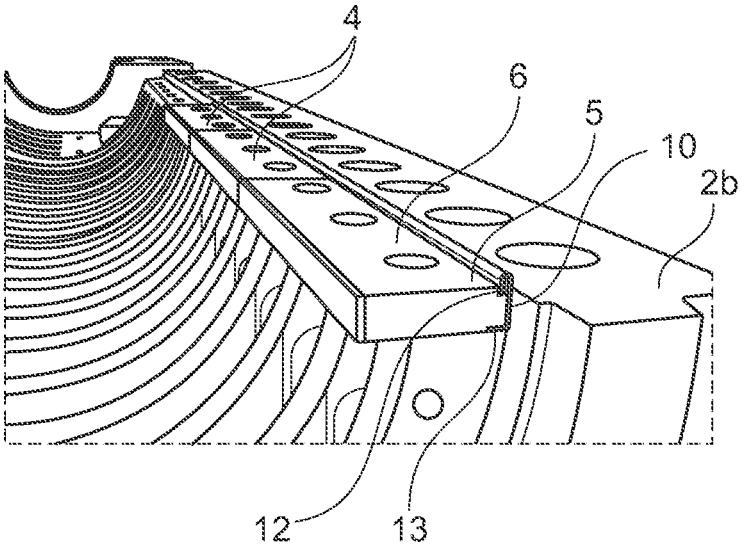
FIG. 2: shows a perspective illustration of a detail of a pressing apparatus according to the invention in the region of a contact surface of a strainer-cage segment, without cage bars inserted.

FIG. 2 shows a perspective illustration of a detail of a pressing apparatus (1) according to the invention in the region of a contact surface (5) of a strainer-cage segment (4), without cage bars inserted. A first sealing strip (10) of a sealing device (9) is arranged on the outer side of the clamping bar (6), as seen in the radial direction of the strainer cage. The clamping bar (6) has a respective recess (12, 13) in the outer region of the contact surface (5) and on the side which is located opposite the contact surface (5). Said recesses are realized, for example, by virtue of the edges of the clamping bar (6) being milled. The sealing strip (10) is arranged in the recesses (12, 13) so as to enclose the clamping bar (6) on the outer side. A first end of the sealing strip (10) is arranged in the recess (13), which is arranged on that side of the clamping bar (6) or of a scraper which is located opposite the contact surface (5). A second end of the sealing strip (10) is designed in a U-shaped manner and is arranged at least to some extent in the recess (12), which is arranged on the side of the contact surface (5). The closed side of the U-shaped, second end of the sealing strip (10) here projects from the recess (12). As an alternative to the clamping bar (6), use can be made of a scraper.

Figure 3:
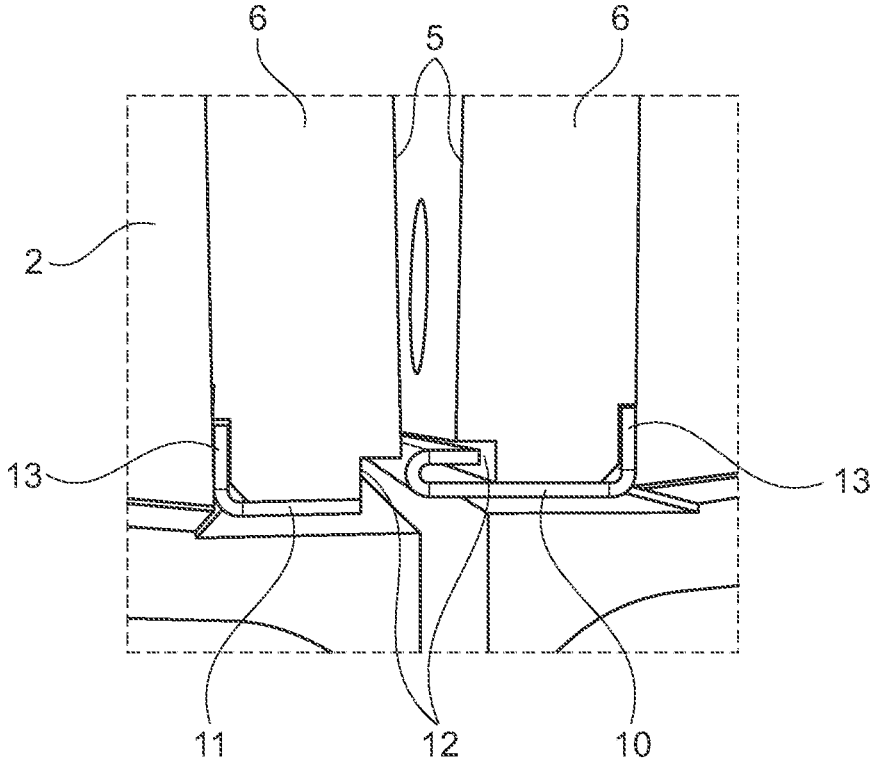
FIG. 3: shows a perspective illustration of a detail of a pressing apparatus according to the invention in the region of the contact surfaces of two strainer-cage segments prior to connection.

FIG. 3 illustrates a perspective view of a detail of a pressing apparatus (1) according to the invention in the region of the contact surfaces (5) of a first strainer-cage segment (4) and a second strainer-cage segment (4) prior to the strainer-cage segments (4) being connected to one another to form a strainer cage. Alongside the first sealing strip (10) of the first strainer-cage segment (4), the sealing device (9) has a second sealing strip (11) of the second strainer-cage segment (4), said second sealing strip being arranged in the region of that side of the clamping bar (6) which is located opposite the contact surface (5) and also on the outer side of the clamping bar (6) of the second strainer-cage segment (4). The recesses (12, 13) in the clamping bar (6) are formed here such that the sealing strips (10, 11) are fixed in a form-fitting manner in the region of the respective strainer-cage segment (4) by a respective recess (13). The U-shaped, second end of the first sealing strip (10) projects from the recess (12) in the clamping bar (6) of the first strainer-cage segment (4) into the region of the recess (12) of the clamping bar (6) of the second strainer-cage segment (4). The first sealing strip (10) here projects from the contact surface (5) to an extent which is greater than the depth of the corresponding recess (12) of the second strainer-cage segment (4).

Figure 4:
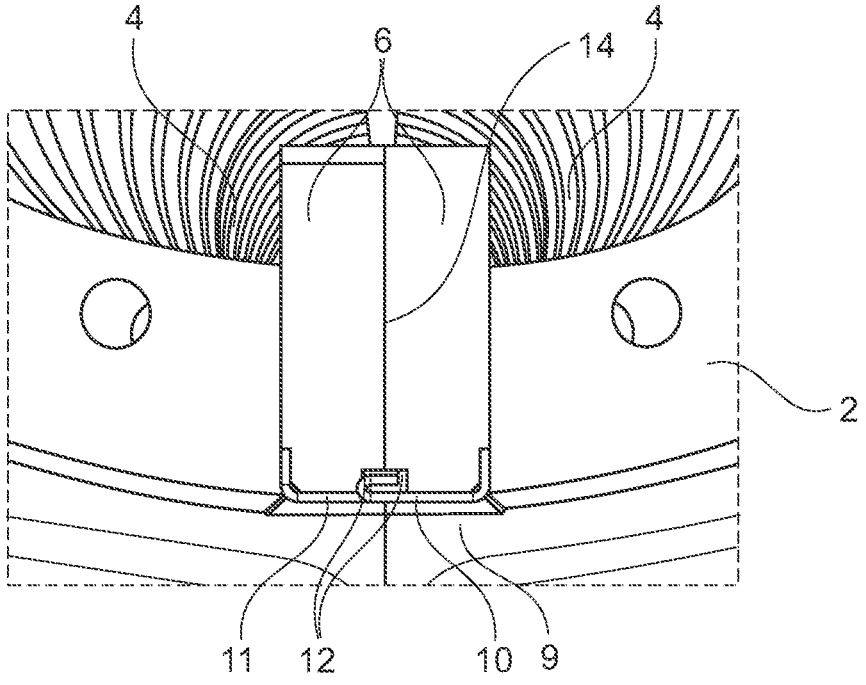
FIG. 4: shows a perspective illustration of a detail of a pressing apparatus according to the invention in the region of the contact surfaces of two interconnected strainer-cage segments, without cage bars inserted.

FIG. 4 shows a perspective illustration of a detail of a pressing apparatus (1) according to the invention in the region of the contact surfaces (5) of the strainer-cage segments (4) from FIG. 3, wherein the first and the second strainer-cage segments (4) are connected to one another. A narrow gap 14 is formed between the contact surfaces (5) of the strainer-cage segments (4) and is sealed in the outward direction with the aid of the sealing device (9). The first sealing strip (10) of the sealing device (9) is deformed by those forces in the recesses (12) of the clamping bar (6) of the strainer-cage segments (4) which brace the contact surfaces (5) of the strainer-cage segments (4) against one another, such that the gap (14) is closed in the region of the sealing device (9).

Figure 5:
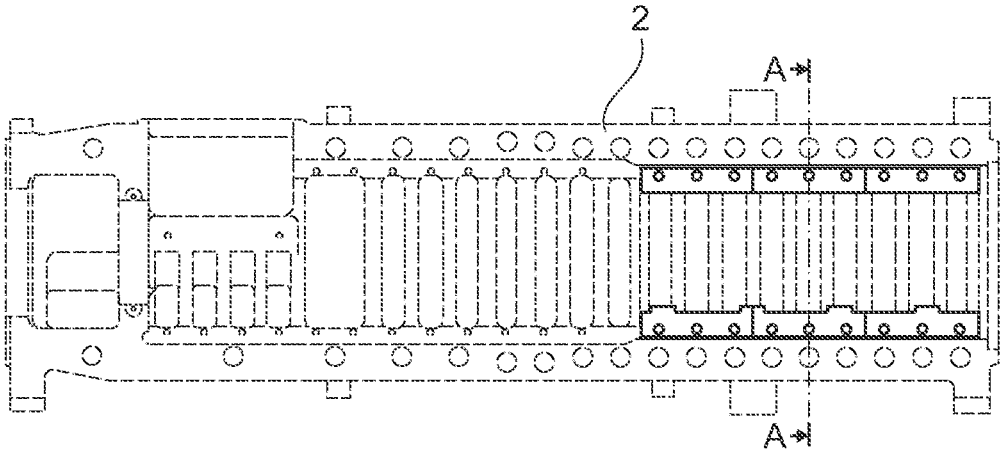
FIG. 5: shows a plan view of a first half of a cage frame with strainer-cage segments inserted into three strainer-cage portions, without cage bars inserted.

FIG. 5 illustrates a plan view of a first half of a cage frame (2) with strainer-cage segments (4) inserted into three strainer-cage portions (3), without cage bars inserted.

Figure 6:
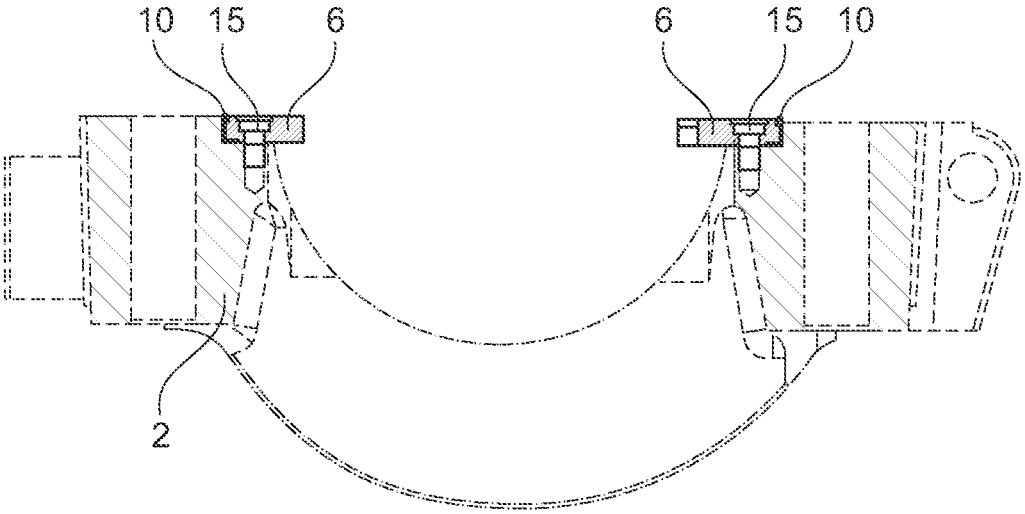
FIG. 6: shows a section taken in the region of a strainer-cage segment from FIG. 5, FIG. 7: shows a detail of the strainer-cage segment from FIG. 6 in the region of the contact surfaces.

FIG. 6 shows a section taken along section axis A-A in the region of a strainer-cage segment (4) from FIG. 5.

Figure 7:
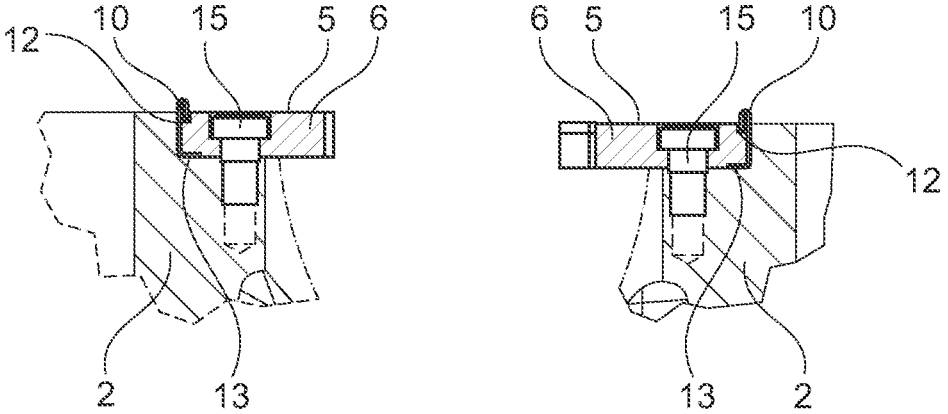

FIG. 7 illustrates a detail of the strainer-cage segment (4) from FIG. 6 in the region of the contact surfaces (5). The clamping bars (6) and/or scrapers (6*a*) have openings and are connected to the cage frame (2) with the aid of fastening means (15), which are arranged in the openings and are designed in the form of screws. On the outside, a respective first sealing strip (10) is fixed in a form-fitting manner with the aid of the clamping bars (6) and/or scrapers.

Figure 8:
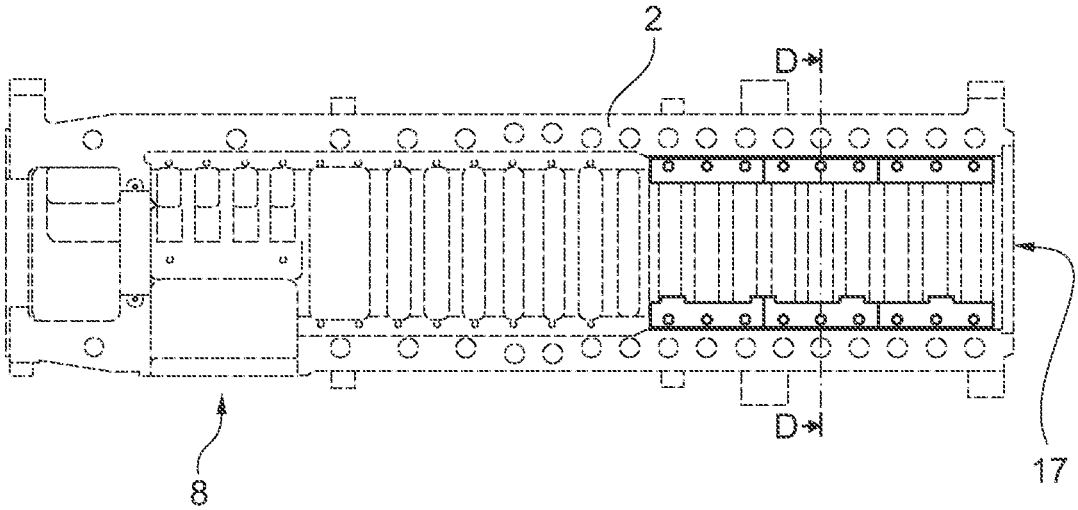
FIG. 8: shows a plan view of a second half of a cage frame with strainer-cage segments inserted into three strainer-cage portions, without cage bars inserted.

FIG. 8 shows a plan view of a second half of a cage frame (2) with strainer-cage segments (4) inserted into three strainer-cage portions (3), without cage bars inserted. Also evident, in particular, are the pressing-material entry (8) and an exit (17) for the pressing material, wherein the pressing material leaves the press in the form of a press cake.

Figure 9:
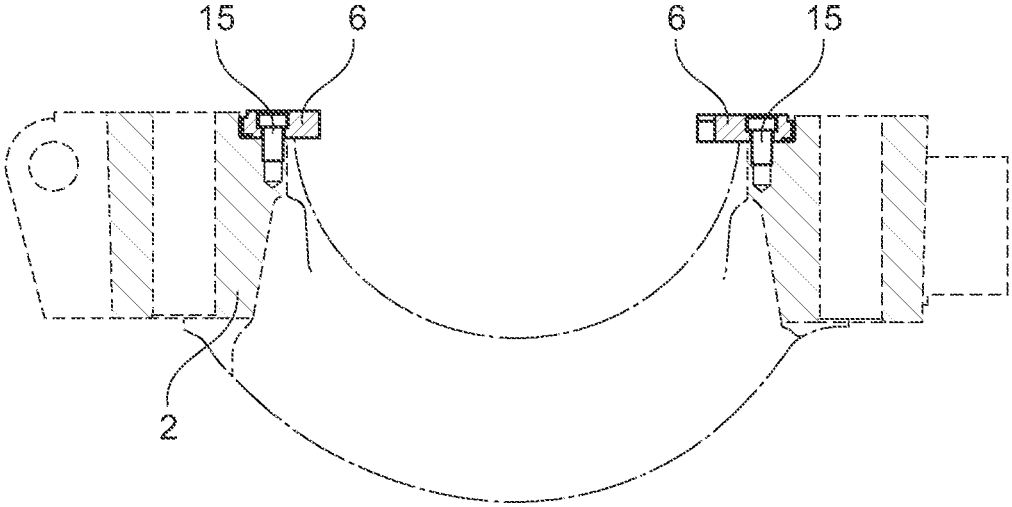
FIG. 9: shows a section taken in the region of a strainer-cage segment from FIG. 8, FIG. 10: shows a detail of the strainer-cage segment from FIG. 9 in the region of the contact surfaces.

FIG. 9 illustrates a section taken along section axis D-D in the region of a strainer-cage segment (4) from FIG. 8.

Figure 10:
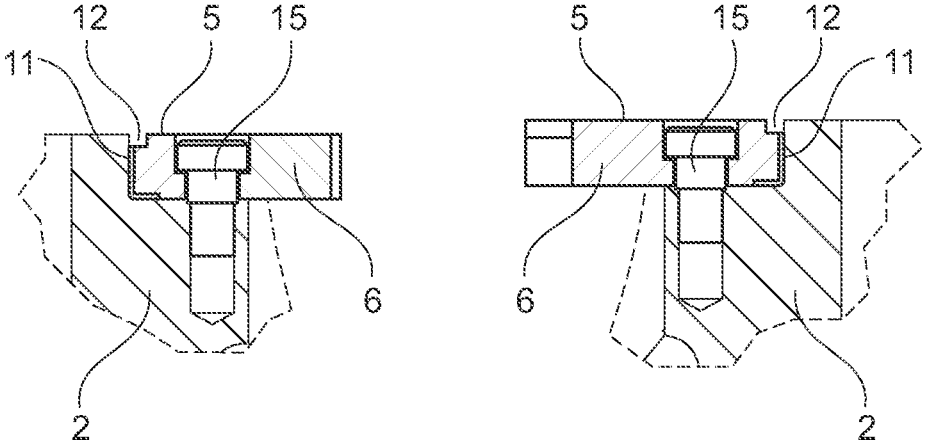

FIG. 10 shows a detail of the strainer-cage segment (4) from FIG. 9 in the region of the contact surfaces (5) of the strainer-cage segment (4). The clamping bars (6)/scrapers have openings and are connected to the cage frame (2) with the aid of fastening means (15), which are arranged in the openings and are designed in the form of screws. On the outside, a respective second sealing strip (10) is fixed in a form-fitting manner with the aid of the clamping bars (6)/scrapers. The recess (12) of the clamping bars (6), said recess being arranged in each case on the side of the contact surface (5), is free.

Figure 11:
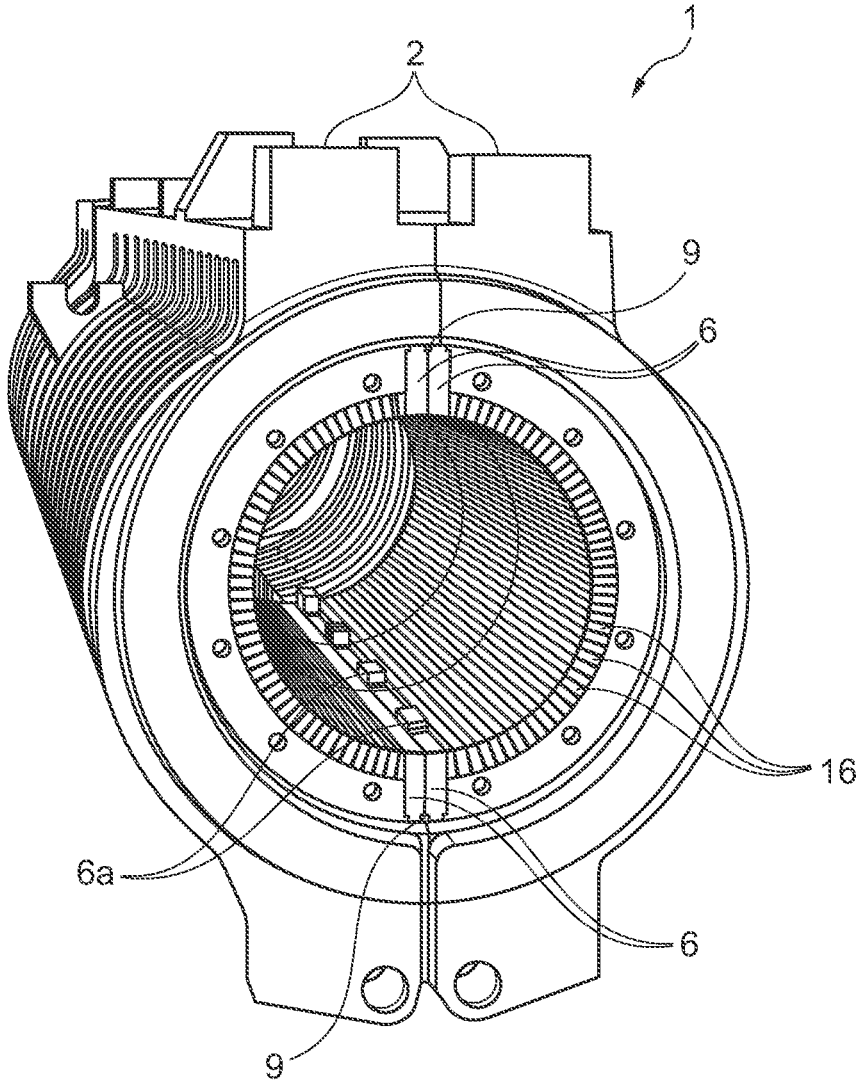
FIG. 11: shows a perspective illustration of a cage frame of a pressing apparatus according to the invention in a closed state with cage bars inserted but without a pressing and feeding screw.

FIG. 11 is a perspective illustration of a cage frame (2) of a pressing apparatus (1) according to the invention in a closed state with cage bars (16) inserted in a strainer-cage portion (3), but without a pressing and feeding screw.

While specific embodiments of the invention have been shown and described in detail to illustrate the inventive principles, it will be understood that the invention may be embodied otherwise without departing from such principles.

I claim:

1. A pressing apparatus, comprising: a cage frame for accommodating a strainer cage, wherein the strainer cage is split in a longitudinal direction into at least two strainer-cage segments: and, in each case, at least one sealing device is arranged in a region of contact surfaces of the strainer-cage segments, wherein the sealing device is configured to outwardly seal, as seen in the radial direction of the strainer cage, a gap which is present between the contact surfaces of two interconnected strainer-cage segments, wherein, in a region of a first of the strainer-cage segments, the sealing device has a first sealing strip that is deformable by forces bracing the contact surfaces of the two interconnected strainer-cage segments so that the gap which is present between the contact surfaces is sealed, wherein the first sealing strip of the sealing device projects from the contact surface of the first strainer-cage segment, wherein a first end of the sealing strip is arranged in a recess of the first strainer-cage segment, and wherein a second end of the first sealing strip has a U-shaped contour.

2. The pressing apparatus according to claim 1, wherein the first sealing strip is fixed in a form-fitting manner in a region of the contact surface of the first strainer-cage segment.

3. The pressing apparatus according to claim 1, wherein at least one of the strainer-cage segments has at least one recess or a groove in a region of the contact surface.

4. The pressing apparatus according to claim 3, wherein the first sealing strip of the sealing device projects from the contact surface of the first strainer-cage segment into the recess of the second strainer-cage segment so that when the strainer-cage segments are connected the first sealing strip is deformed to seal the gap located between the contact surfaces.

5. The pressing apparatus according to claim 4, wherein the first sealing strip projects from the contact surface of the first strainer-cage segment to an extent which is greater than a depth of the recess or groove in the region of the corresponding contact surface of the second strainer-cage segment.

6. The pressing apparatus according to claim 1, wherein the sealing device has a second sealing strip that is fixed in a form-fitting manner in a region of the contact surface of the second strainer-cage segment.

7. The pressing apparatus according to claim 1, further comprising a clamping bar arranged to fix the first sealing strip in the region of the contact surface of the strainer-cage segment.

8. The pressing apparatus according to claim 5, wherein the recess or groove is realized on or in a scraper and/or clamping bar arranged in the region of the contact surface of the second strainer-cage segment.

* * * * *